United States Patent [19]

Da Costa

[11] Patent Number: 5,004,410

[45] Date of Patent: Apr. 2, 1991

[54] HIGH FREQUENCY NOISE SUPPRESSOR FOR HERMETIC ROTARY COMPRESSORS

[75] Inventor: Caio M. F. N. Da Costa, Joinville, Brazil

[73] Assignee: Empresa Brasileira de Compressores-S/A-Embraco, Joinville-SC, Brazil

[21] Appl. No.: 488,515

[22] Filed: Feb. 27, 1990

Related U.S. Application Data

[63] Continuation-in-part of Ser. No. 305,480, Feb. 1, 1989, abandoned.

[30] Foreign Application Priority Data

Apr. 2, 1988 [BR] Brazil ..... PI 8800513

[51] Int. Cl.[5] ..... F04C 29/06; F04C 18/356

[52] U.S. Cl. ..... 418/63; 418/181; 181/403

[58] Field of Search ..... 418/63, 181; 417/312; 181/403

[56] References Cited

U.S. PATENT DOCUMENTS

| | | | |
|---|---|---|---|
| 3,513,476 | 5/1970 | Monden et al. | 417/372 |
| 4,429,351 | 1/1984 | Sano | 418/63 |
| 4,618,317 | 10/1986 | Matsuzaki | 418/63 |
| 4,629,403 | 12/1986 | Wood | 418/63 |

FOREIGN PATENT DOCUMENTS

| | | | |
|---|---|---|---|
| 0146294 | 11/1980 | Japan | 418/63 |

*Primary Examiner*—John J. Vrablik
*Assistant Examiner*—David L. Cavanaugh
*Attorney, Agent, or Firm*—Darby & Darby

[57] ABSTRACT

A system to dampen high frequency noises in hermetic rotary compressors of the rolling piston type, usually employed in small refrigeration and air conditioning compressors without causing an increase in the cylinder dead volume, and, accordingly, a decrease in the compressor volumetric performance. A resonating chamber is provided in the cylinder or bearing and communication between the compression chamber to the resonator chamber is provided by the vane which rides on the rotating piston as it tilts toward and away from the resonating chamber or passage leading to the chamber.

9 Claims, 4 Drawing Sheets

HIGH FREQUENCY NOISE SUPPRESSOR FOR HERMETIC ROTARY COMPRESSORS

This application is a continuation-in-part of prior Serial No. 07/305,480 filed Feb. 1, 1989.

BACKGROUND OF THE INVENTION

The present invention relates to an improvement introduce compressors and, more particularly, to a new muffler resonance chamber construction for high frequency noises caused by compression pulses occurring inside the cylinder of a compressor of that type, usually employed in small refrigeration and air conditioning systems.

Hermetic rotary compressors with a rolling piston and/or sliding vane arc high internal pressure high side compressors wherein the refrigeration fluid compressed in the compression chamber is discharged directly inside the compressor shell. This causes the noise in this kind of compressor to be largely influenced by the compression and discharge pulses that result in a characteristic high-frequency noise. The solution usually employed to reduce the noise level in rotary compressors is to provide an intermediate muffler between the discharge from the compression chamber and the inside of the compressor shell. It happens that this solution works only to reduce the noise caused by the discharge Pulses and has no effect on the compression pulses, that is the pressure pulses in the refrigerating fluid flow which are already happening in the compression chamber inside the cylinder before the discharge. Such pulses also generate high frequency noises.

A solution addressed to solve the pressure pulses inside the compression chamber is described on U.S. Pat. No. 4,427,351. That document proposed the provision of a volume adjacent to the cylinder discharge orifice, so that this volume operates as a Helmholtz-type resonance chamber or cavity. Notwithstanding the fact that this chamber effectively attenuates the high-frequency noise, it has the drawback of increasing the cylinder dead volume, which necessarily implies a decrease in the volumetric performance of the compressor. Another drawback is that the manufacturing of the resonant chamber therein proposed is relatively difficult.

OBJECTS OF THE INVENTION

It is a general object of the present invention to provide a new constructive solution for the problem of reducing the high-frequency noise level in rolling piston or sliding vane rotary compressors capable of overcoming the drawbacks presented in the solutions of the prior art.

BRIEF DESCRIPTION OF THE INVENTION

This and other objects of the present invention are achieved by providing a rotary compressor of the type that includes a cylinder housing a rolling piston with an eccentric and a radial vane adapted in a slot in said cylinder. The vane reciprocates in said slot by action of the peripheral surface of the rolling piston which moves it and divides the inner space of the cylinder around the piston into a suction chamber and a compression chamber. The vane is tiltable inside the slot towards said suction and compression chambers. There is also a sound muffling resonance chamber in the cylinder body, in fluid communication with the cylinder compression chamber. In accordance with this invention, the muffling resonance chamber comprises a small cavity made in the cylinder, starting from at least one of its end faces and maintained in fluid communication only with the side of the slot adjacent to the vane side facing the compression chamber. The fluid communication between the small cavity and the inside of the slot is made in a region of the slot wall arranged radially and externally in relation to the region of the slot side touched by the vane, when the vane is tilted toward the suction chamber by action of the differential pressure between the two chambers.

The resonating cavity also can be provided in one of the bearings which are at each end of the cylinder, communication being provided between the cylinder and the bearing.

The constructive arrangement mentioned above allows the sound muffling resonance cavity to be placed in fluid communication with the compression chamber through the gap between the vane and the respective side of the slot, in the initial and final phases of the compression cycle, usually between 0 to 90° and 180 to 360° of the eccentric shaft angular position. Accordingly, the volume of the small cavity or resonance chamber operates as a resonant cavity of the Helmholtz-type resonator, attenuating the pressure pulses inside the compression chambers.

One of the advantages of the resonant cavity constructed in accordance with the present invention is that it does not increase the dead volume of the compression chamber, since the gap formed between the slot wall and the vane is very narrow, of about 10–30 micrometers.

In addition, this gap remains closed in the intermediate phases of the compression cycle, usually corresponding to an angular position of the eccentric shaft between 90 and 180°, and are only reopened at the final phase of compression. This is when the pressure pulses are more intense and of higher frequency, i.e. when the resonator in fact becomes necessary. Another advantage of the cavity to form the resonating sound suppression chamber that it also helps in lubricating the sliding vane.

A further effect of the present invention is decreasing the problem of compression fluid in liquid state in the final stage of compression in the small space formed between the vane, the rolling piston and the cylinder wall. This problem can be specially serious at compressor start-ups, and may cause premature wear of the bearings.

BRIEF DESCRIPTION OF THE DRAWINGS

The invention will be described below with reference to the appended drawings, wherein.

DETAILED DESCRIPTION OF THE INVENTION

Figure 1:
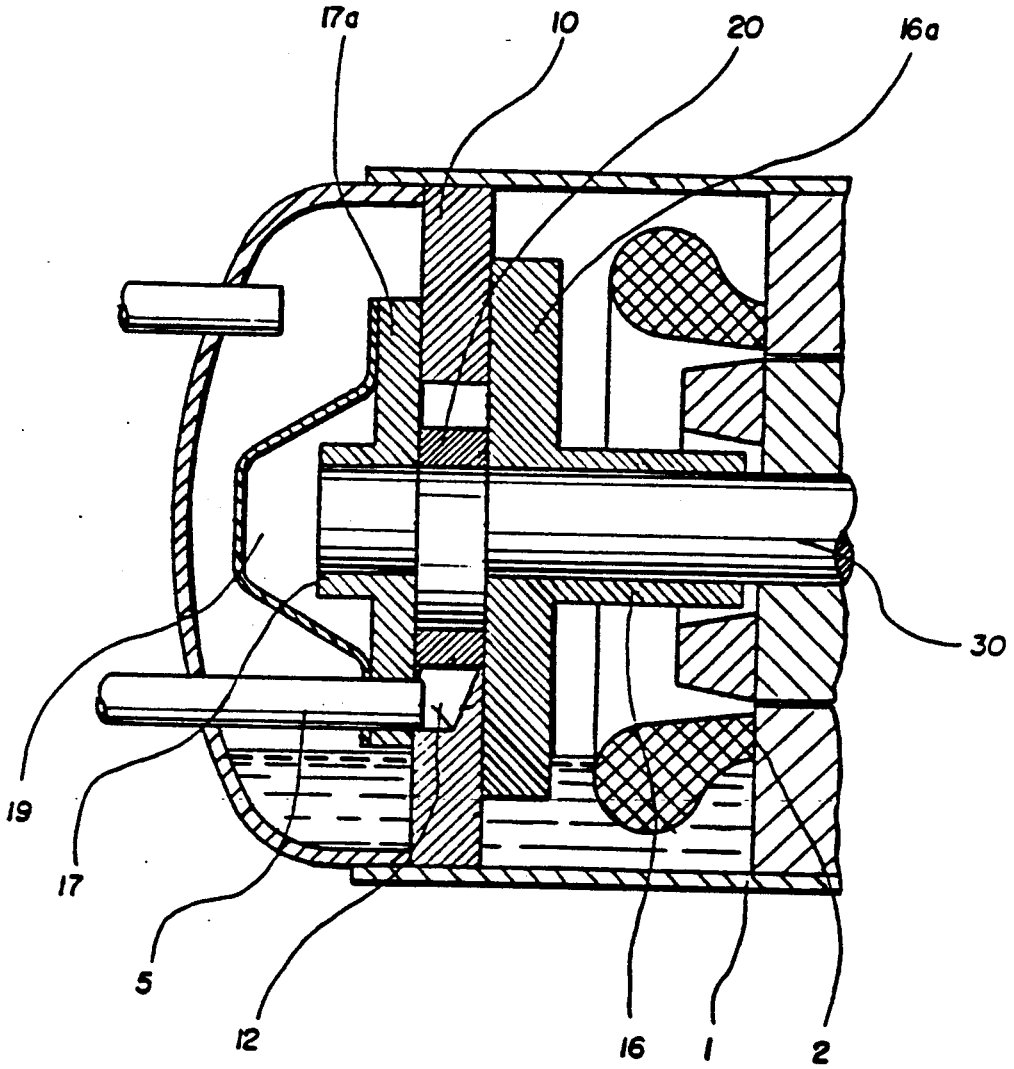
FIG. 1 is a partial, longitudinal cross-section of a hermetic rotary compressor of the type described.
Figure 2:
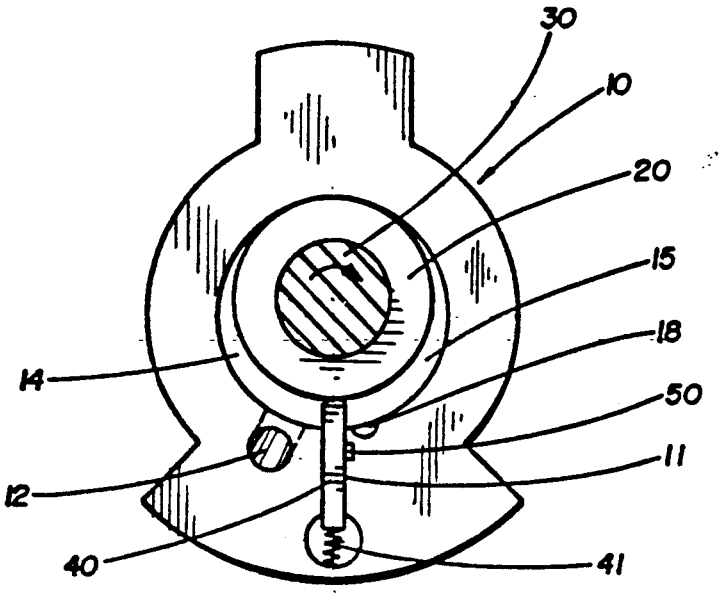
FIG. 2 is a front view of a first configuration of the invention, illustrating the assembly comprised of the cylinder and rolling piston in an intermediate compression position, corresponding to a 180° rotation of the eccentric shaft, and the vane.
Figures 4A, 4B, 4C, 4D:
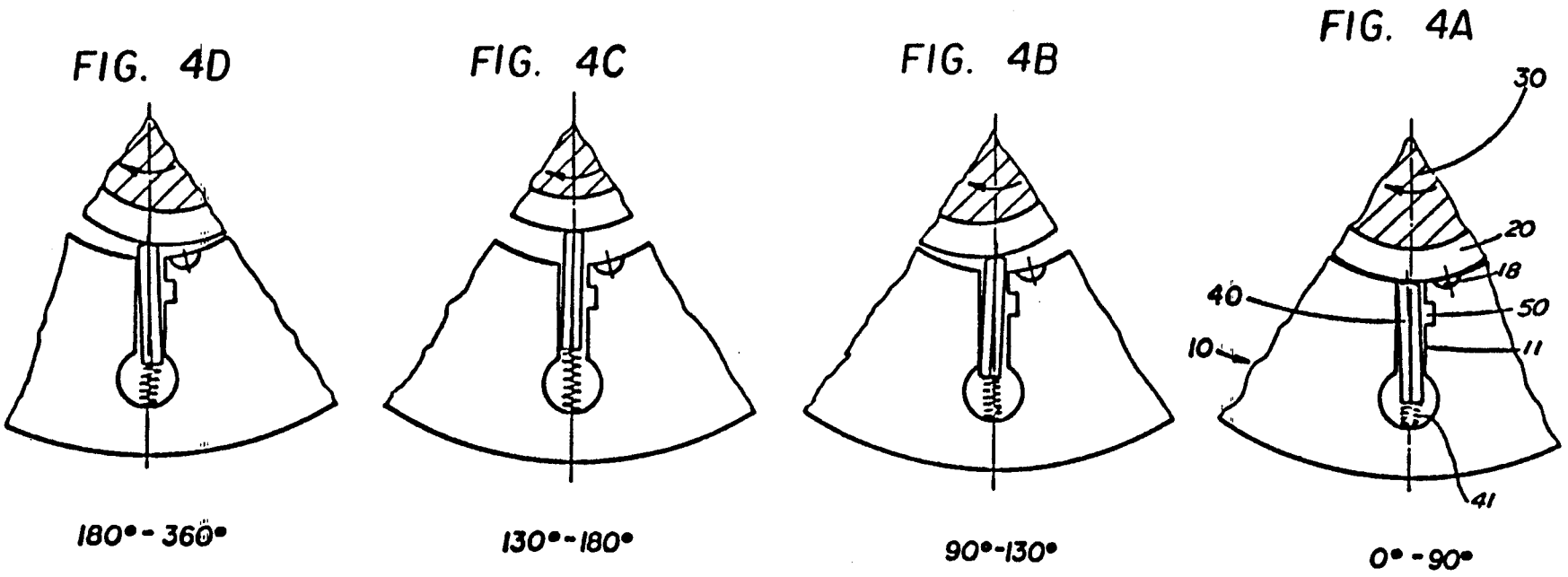
FIG. 4 illustrates in a schematic, front view, the positions assumed by the vane inside the slot beginning to the end of a compression cycle.

In accordance with the drawings, the hermetic rotary compressor comprises a shell 1, wherein are assembled an electric motor 2 and an assembly comprising a cylinder 10 housing a rolling piston 20 driven by a shaft 30 with an eccentric portion supported by a pair of bearings 16 and 17. A radial vane 40 reciprocates in a slot 11 made in the cylinder 10 in a known manner. As illustrated in FIGS. 2 and 4, the vane 40 is constantly urged against the peripheral surface of rolling piston 20 by action of a spring 41 assembled in the blind, enlarged end of the slot 11, so as to reciprocate to the inside of the cylinder 10 and the inside of the slot 11 during the rotation of the rolling piston 20 inside the cylinder.

The vane 40 divides the internal space of the cylinder 10 into a suction chamber 14 and a compression chamber 15. The cylinder 10 also includes an axial suction orifice 12 which is connected to the suction tube 5 and extends up to the suction chamber 14 at a point next to the vane 40. There is a discharge orifice 18, which is connected through an orifice (now shown) made on the flanged portion 17*a* of bearing 17 to the intermediate muffler 19. This muffler 19 has the function of dampening the noise cause by the discharge pulses of the compressed refrigerant gas.

It should be understood that the two extreme opposed faces of cylinder 10 are closed by flanged portions 16*a* and 17*a* of bearings 16 and 17.

In accordance with FIG. 2, the sound muffling resonance chamber 50 assumes the shape of an axial channel or groove made along at least a portion of the cylinder length in the lateral wall of the slot 11 adjacent to the compression chamber 15.

Figure 3:
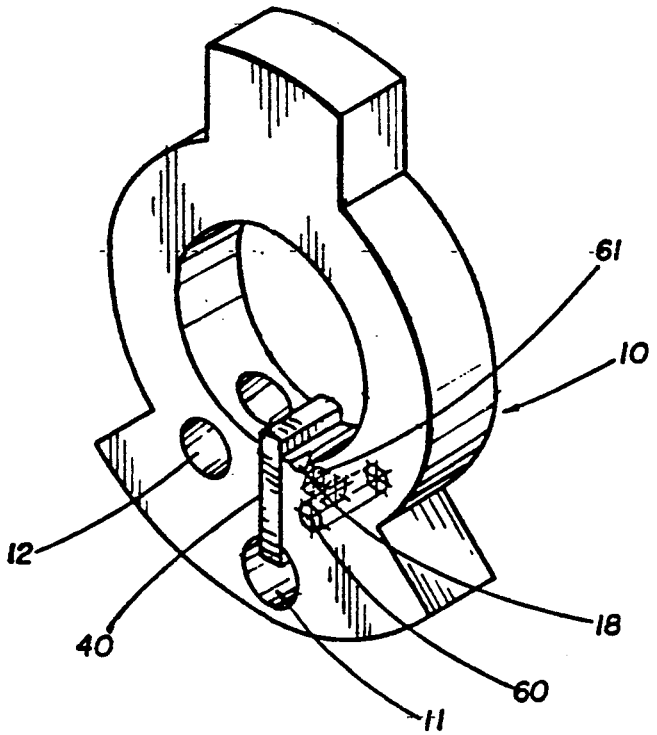
FIG. 3 represents a perspective view of a cylinder carrying the vane and incorporating a constructive variation of the buffler or resonant cavity.

FIG. 3 illustrates another configuration, wherein the sound muffling resonance chamber 60 assumes the shape of an axial orifice made in the cylinder 10 from at least one of the extreme faces thereof, near the lateral wall of the slot 11 adjacent to compression chamber 15, and maintained in fluid communication with the slot 11 through at least one orifice 61 arranged transversely to the lateral wall of the slot.

Considering the new constructive solution for the resonant cavity or sound muffling resonance chambers 50 or 60, as the eccentric shaft rotates, the rolling piston 20 causes a sliding, reciprocating movement to the vane 40 inside the slot 11.

During this movement, the gas compression and spring and rolling piston drag forces act on the vane 40. These forces cause the vane 40 to oscillate around its cross-sectional axis, so that at the beginning of the compression cycle, corresponding to a rotation from 0 to 90° of the eccentric shaft 30, the vane 40 has its top tilted towards the side of the suction chamber 14 (FIG. 4 - A); in the intermediate phase of the compression cycle, corresponding to a rotation angle of 90° to 180° of the eccentric shaft 30, vane 40 will have its top tilted again towards the side of the suction chamber 14 (FIG. 4 - D).

This variation in the tilting of the top of vane 40 periodically causes the opening (when the vane tilts towards the suction chamber side) and the closing (when the vane tilts towards the compression chamber side) of the gap provided between the vane walls and the adjacent wall of the slot 11, a gap through which passes the compressed fluid compressed of the refrigerant gas and some lubricant oil, which sound muffling resonance chambers 50 or 60, that operates as a resonant cavity of the Helmoltz-type resonator.

That is, the theory of a Helmholtz resonator is that a sound of a certain frequency of pulsations originating inside a main volume V (here the compression chamber of the compressor) filled with gas can be attenuated by providing a small volume v (here the sound muffling chamber or cavity 50 or 60) interconnected to the main volume V by a neck with length 1 (here the passage from the top of the slot 11 to the entrance to the sound muffling chamber) and cross section s (here the distance between the face of the vane 40 and the opposing face of the slot in which the vane reciprocates. The values of V, v, 1 and s are selected for the attenuation of the particular frequency sound.

As can be observed on FIG. 4, the sound muffling resonance chamber cavity 50 or 60 communicates with the inside of the slot 11 in a region located radially and externally in respect to the region of the slot face adjacent to the compression chamber touched by the vane 40, when the vane is tilted towards the suction chamber 14, so that the fluid communication between the cavity 50 or 60 and the cylinder compression chamber be established only when the vane 40 is tilted towards the suction chamber 14.

Figure 5:
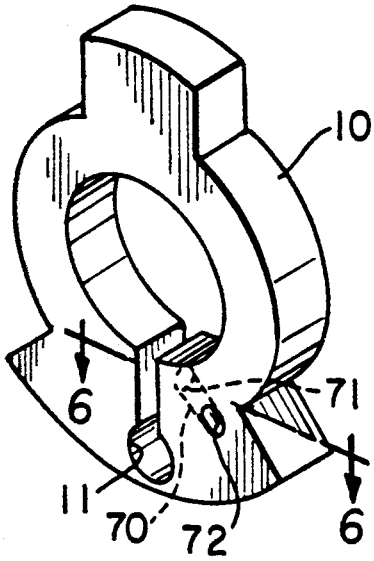
FIG. 5 is a perspective view of another embodiment of the invention.
Figure 6:
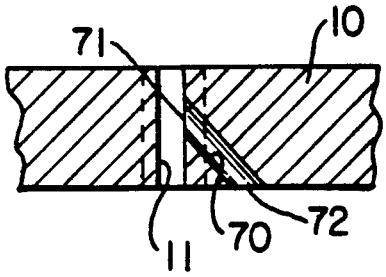
FIG. 6 is a cross-sectional view of the embodiment of FIG. 5 along lines 6—6.

FIGS. 5 and 5 show a further embodiment of the invention. Here the sound muffling chamber or cavity 70 is a diagonal slot whose inner inlet end 71 communicates with the face of the vane. Slot 70 is on the compression chamber side of the cylinder. The slot 70 extends diagonally and downwardly from the inlet point 71 near the face of the bearing or sub-bearing 16 or 17 and terminates at 72 at the face of the cylinder at the bearing or sub-bearing. The chamber 70 operates as described above. That is, as the vane 12 is titled during the rotation of the piston, the opening 71 to the chamber 70 is opened and closed.

Figure 7:
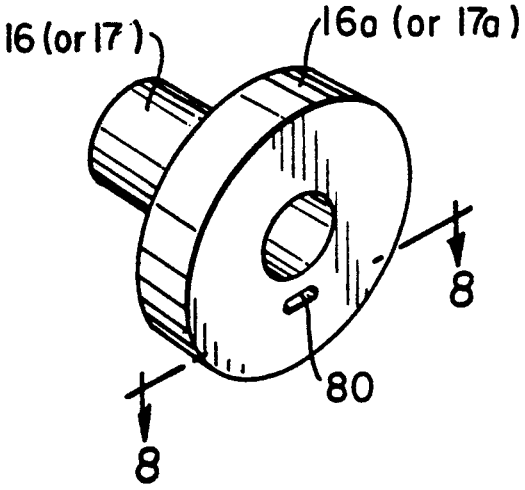
FIG. 7 is a perspective view of an embodiment with the cavity in the cylinder wall.
Figure 8:
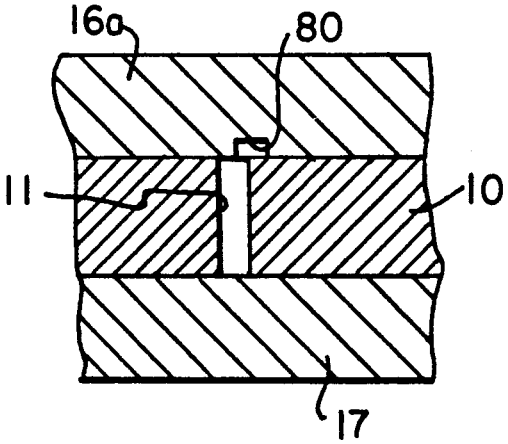
FIG. 8 is a cross-section of the cylinder along lines 8—8 of FIG. 7.

FIGS. 7 and 8 show a further embodiment of the invention. Here the sound muffling cavity 80 is formed as an oblong recess in the face of main bearing or sub-bearing 16*a* or 17*a* which opposes the cylinder 10. As seen in FIG. 8, there is communication between the vane slot 11 and the cavity 80. The vane 40 as it is tilted back and forth in the slot, as shown in FIG. 4, opens and closes the communication between the vane slot 11 and the cavity 80. The principles of the operation of the resonating cavity are as previously described.

I claim:

1. A suppressor for reducing pulsating noises in a hermetic rotary compressor comprising:

a housing, a cylinder within said housing, a bearing on each face of the cylinder, a piston with an eccentric portion rotating within said cylinder, a slot in the cylinder, a vane having a portion riding on the piston eccentric portion to be reciprocated inn the slot, said vane in cooperation with the bearings dividing the space in the cylinder surrounding the piston into a suction chamber and a compression chamber, the vane being tiltable toward one side or the other of the slot depending upon the position of the piston and the pressure differential between the two chambers, a sound muffling resonating cavity formed in one of the cylinder and bearings, the volume of the sound muffling resonating cavity selected relative to the volume of the compression chamber and frequency of the noise to be muffled to achieve muffling of pulsations of sound of a given frequency, said vane when tilted toward the compression chamber side providing communication between the compression chamber and the sound muffling resonating cavity and closing the communication when tilted toward the compression chamber side.

2. A sound suppressor as in claim 1 wherein the sound muffling resonating cavity is formed on the compression side of the vane.

3. A sound suppressor as in claim 2, wherein the sound muffling resonating cavity is on the wall of the slot on the compression side of the vane.

4. A sound suppressor as in claim 2, wherein the sound muffling cavity is in the wall of the chamber spaced from the slot, and the cavity has a passage from the face of the wall of the slot on the compression side of the vane to the cavity, the passage on the face of the slot being opened and closed as the vane tilts.

5. A sound suppressor as in claim 2, wherein said cavity extends across at least a part of the cylinder starting from one of the cylinder outer faces.

6. A sound suppressor as in claim 5, wherein said cavity extends across the entire thickness of the cylinder.

7. A sound suppressor as in claim 2, wherein said cavity comprises a passage having one end at the face of the vane slot on the compression chamber side of the vane, the slot extending diagonally and downwardly across the cylinder.

8. A sound suppressor as in claim 2, wherein said cavity comprises a recess inn the face of one of the bearings opposing the cylinder on the compression chamber side of the vane, the vane as it is tilted opening and closing communication between the slot and the chamber.

9. A sound suppressor as in claim 8, wherein said recess is generally oblong.

* * * * *

UNITED STATES PATENT AND TRADEMARK OFFICE

CERTIFICATE OF CORRECTION

PATENT NO. : 5,004,410

DATED : April 2, 1991

INVENTOR(S) : HIGH FREQUENCY NOISE SUPPRESSOR FOR HERMETIC ROTARY COMPRESSORS (AS AMENDED)

It is certified that error appears in the above—identified patent and that said Letters Patent is hereby corrected as shown below:

On the title page:

Under designation [30] please delete "April 2, 1988" and insert --February 4, 1988--.

Signed and Sealed this

Twentieth Day of October, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 5,004,410

DATED : April 2, 1991

INVENTOR(S) : Caio M. F. N. Da Costa

It is certified that error appears in the above-identified patent and that said Letters Patent is hereby corrected as shown below:

On the title page of the patent, Section (73), please delete "Empresa Brasileira de Compressores-S/A-Embraco" and substitute therefor —Empresa Brasileira de Compressores S.A.- EMBRACO—.

Signed and Sealed this

Eleventh Day of October, 1994

*Attest:*

*Attesting Officer*

Bruce Lehman

BRUCE LEHMAN

*Commissioner of Patents and Trademarks*